US006631586B1

(12) United States Patent
Nakagomi et al.

(10) Patent No.: US 6,631,586 B1
(45) Date of Patent: Oct. 14, 2003

(54) OPENING AND CLOSING STRUCTURE OF WINDOW MEMBER

(75) Inventors: Kimito Nakagomi, Aichi (JP); Hideyuki Hashimoto, Aichi (JP)

(73) Assignee: Asahi Glass Company Ltd., Tokyo (JP)

( * ) Notice: Subject to any disclaimer, the term of this patent is extended or adjusted under 35 U.S.C. 154(b) by 0 days.

(21) Appl. No.: 09/403,742

(22) PCT Filed: Feb. 26, 1999

(86) PCT No.: PCT/JP99/00932

§ 371 (c)(1),
(2), (4) Date: Nov. 24, 1999

(87) PCT Pub. No.: WO99/43918

PCT Pub. Date: Sep. 2, 1999

(30) Foreign Application Priority Data

Feb. 27, 1998 (JP) ..... 10-047443

(51) Int. Cl.[7] ..... E05F 15/08
(52) U.S. Cl. ..... 49/349; 49/362
(58) Field of Search ..... 49/348, 349, 360, 49/362, 502

(56) References Cited

U.S. PATENT DOCUMENTS

| | | | | | |
|---|---|---|---|---|---|
| 1,647,901 | A | * | 11/1927 | Carver | 49/362 |
| 1,903,358 | A | | 4/1933 | Nicholson | |
| 3,736,702 | A | | 6/1973 | Pickles | |
| 4,074,463 | A | * | 2/1978 | Colanzi | 49/349 X |
| 4,788,795 | A | * | 12/1988 | Pinsonneault | 49/362 X |
| 4,920,697 | A | * | 5/1990 | Curtis et al. | |
| 5,035,083 | A | * | 7/1991 | Kruzich | 49/349 X |
| 6,073,395 | A | * | 6/2000 | Fenelon | 49/349 X |

FOREIGN PATENT DOCUMENTS

| | | | |
|---|---|---|---|
| DE | 197 03 720 | | 7/1998 |
| FR | 1 011 339 | | 6/1952 |
| JP | 63-138383 | | 9/1988 |
| JP | 5-2779 | | 1/1993 |
| JP | 10-44766 | * | 2/1998 |

* cited by examiner

*Primary Examiner*—Jerry Redman
(74) *Attorney, Agent, or Firm*—Oblon, Spivak, McClelland, Maier & Neustadt, P.C.

(57) ABSTRACT

An opening and shutting structure for a window member. The structure includes an elevating device for ascending and descending a glass sheet to a housing section. The elevating device is provided with an elevating member fixed to the glass sheet and a driving section for moving the elevating member in the longitudinal direction. The elevating member is attached to a front side portion of the glass sheet. Thus, the structure can hold a heavy article such as a motor in a corner portion in a door main body.

23 Claims, 4 Drawing Sheets

OPENING AND CLOSING STRUCTURE OF WINDOW MEMBER

BACKGROUND OF THE INVENTION

1. Field of the Invention

The present invention relates to an opening and shutting structure for a window member. In particular, the present invention relates to an opening and shutting structure for a window member, which can locate a heavy article such as a motor or the like at a corner portion in a door main body.

2. Discussion of the Background

Recent years, in a door for an automobile, an opening and shutting structure for a window member wherein a glass sheet is ascended or descended to a door main body by means of a motor, has widely been used. In such opening and shutting structure for a window member, when a conventional manual type elevating mechanism is replaced by a motor-driven system, a motor is in many cases located in a substantially central portion of the door main body.

In many cases, accessories such as, for example, various kinds of switches and a speaker or the like are located in the central portion of the door main body. Accordingly, the provision of the motor in a substantially central portion of the door main body may cause a disadvantage of mutual interference.

SUMMARY OF THE INVENTION

The present invention has been achieved in considering the above-mentioned problem, and it is an object of the present invention to provide an opening and shutting structure for a window member which can locate a heavy article such as a motor or the like at a corner portion of a door main body.

To achieve the above-mentioned object, the present invention is to provide an opening and shutting structure for a window member comprising a plate-like window member for opening and shutting a window opening, a housing section provided in a lower portion of the window opening to house the window member and an elevating means or mechanism for raising or lowering the window member between the window opening and the housing section, wherein the elevating means or mechanism is provided with an elevating member which has a predetermined length and is fixed to the window member, and a driving section is housed in the housing section to move the elevating member in a longitudinal direction, wherein the elevating member is fixed to a side portion of the window member so as to be along an ascending/descending direction.

In the opening and shutting structure for a window member constructed as described above, the elevating member is fixed to a side portion of the window member so as to be along a direction of ascending or descending the window member. Accordingly, the driving section such as a motor or the like can be located in a corner portion of the door main body which constitutes, for example, a door for an automobile. Thus, the above-mentioned object can be achieved.

For the opening and shutting structure for a window member, it is preferable that an elastic member is housed in the housing section and is attached to a lower side portion of the window member so that the elastic member urges the window member in a direction for projecting the window member from the housing section.

In the opening and shutting structure for a window member, the window member is urged by the elastic member to project from the housing section. Accordingly, the window member as a heavy article can smoothly be ascended immediately after the driving section is actuated.

Further, for the opening and shutting structure for a window member, it is preferable that the elastic member contacts the side portion of the window member, which opposes the side with which the elevating member is attached.

Since the elastic member contacts the side portion of the window member which opposes the side with which the elevating member is attached in the opening and shutting structure for a window member, there is no risk that the window member inclines due to its own weight toward the other side even when the elevating member is fixed to only a side of the window member, and therefore, the window member can stably be ascended or descended.

The opening and shutting structure for a window member can suitably be used for a window for an automobile. With such opening and shutting structure, means for raising or lowering the window member can be arranged without any interference with various members disposed in a central portion of a door for an automobile. In addition, the elevating means or mechanism can be disposed at a corner portion of the door main body without locating a relatively heavy, large-sized structural article such as a motor or the like in a central portion of the door which is apt to cause a deformation of a side face of the automobile at a time of collision.

Further, in the opening and shutting structure for a window member, it is preferable to use a leaf spring formed in a substantially U-shape as the elastic member. In the opening and shutting structure for a window member thus constructed, since the elastic member is the leaf spring formed to have a substantially U-shape, the structure of the housing section can be simplified and the weight can be reduced.

For the opening and shutting structure for a window member, it is preferable to provide a frame extending in a direction of ascending or descending the window member from an opening of the housing section so that the frame can guide the elevating member.

In the opening and shutting structure for a window member, since the elevating member projecting from the housing section is guided by the frame, there is no risk that the window member is deflected.

In the case described above, it is preferable that a slide-contact member made of a soft resin is provided along the frame, and both front and back surfaces of the window member and a fitting member are in slide-contact with a slide-contact portion of the slide-contact member.

In the opening and shutting structure for a window member thus constructed, since the slide-contact member made of a soft resin provided along the frame is capable of slide-contacting the front and back surfaces of the window member, a certain waterproofness can be obtained.

In this case, it is desired that the slide-contact member is subjected to a hardwearing treatment.

The elevating member preferably comprises a fitting member for cramping the window member, a rack connected to the fitting member and a driving section including a pinion gear is meshed with the rack.

In the opening and shutting structure for a window member, since the rack of the elevating member is meshed with the pinion gear of the driving section, the window member can assuredly be raised or lowered without causing a defecting operation such as slippage or the like.

In this case, the rack member should be formed of a round rod. Then, the rack member can be bent corresponding to the shape of a glass sheet.

DETAILED DESCRIPTION OF THE PREFERRED EMBODIMENTS

Figure 1:
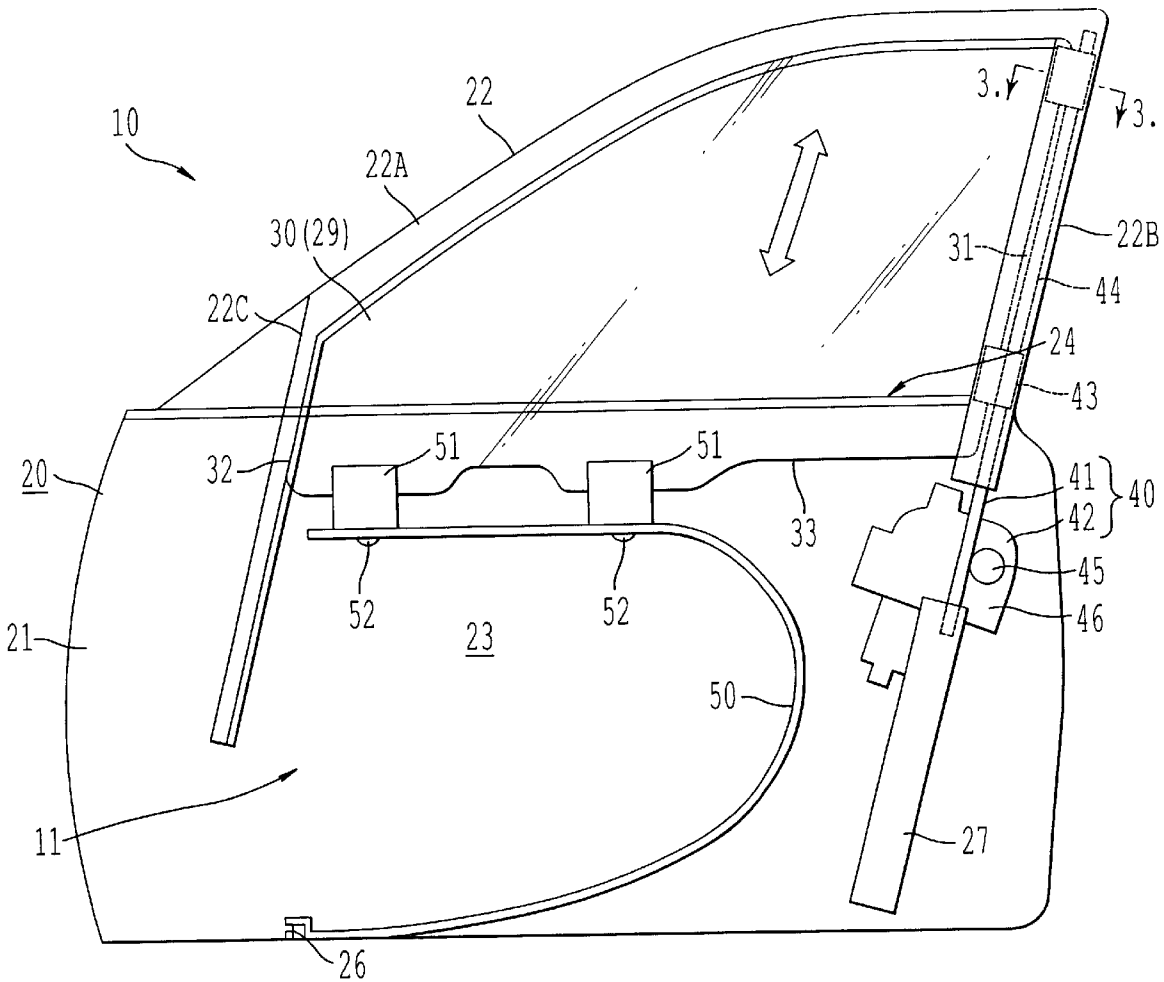
FIG. 1 is a diagrammatical view showing an example of the opening and shutting structure for a window glass according to the present invention.

Preferred embodiments of the present invention will be described with reference to the drawings. FIG. 1 is a diagrammatical view showing an embodiment of the opening and shutting structure for a window glass according to the present invention wherein a left side of drawing indicates a front side of an automobile and a right side of drawing indicates to a rear side of the automobile.

FIG. 1 shows a side door 10 for a front seat of an automobile. The side door 10 is provided with a door main body 20 and a glass sheet 30 as a window member, which can be housed in the door main body 20. For the side door 10, an opening and shutting structure for a window member 11 is employed to raise or lower the glass sheet 30 with respect to the door main body 20. which can be housed in the door main body 20. For the side door 10, an opening and shutting structure for a window member 11 is employed to ascend or descend the glass sheet 30 to the door main body 20.

The door main body 20 has an inner panel (not shown) formed to have a predetermined shape by press-shaping, an outer panel 21 of substantially rectangular shape to form an outer plate for the automobile, which faces a side face of the inner panel, and a sash 22 attached to the inner panel. The outer panel 21 is provided to cramp the a sash 22 in association with the inner panel.

The door main body 20 has a hollowed housing section 23 between the inner panel and the outer panel 21. At a door waist portion, an opening 24 through which the glass sheet 30 is extended or retracted is formed. The sash 22 is projected from the opening 24. A window opening 29 is formed in a portion surrounded by the sash 22 and the door waist portion. In a case of a so-called hard-top type automobile without the sash, the window opening 29 is formed in a portion surrounded by a part of the automobile body when doors are shut and the door waist portion.

The sash 22 comprises a first frame 22A formed to follow the front pillar and the roof side rail of the automobile, i.e., in a substantially arched shape, a second frame 22B connected to an end portion (e.g. a right side in the drawing) of the first frame 22A and extending in a substantially linear form along the center pillar and a third frame 22C connected to the other end (a left side in the drawing) of the first frame 22A and extending parallel to the second frame 22B. in a substantially linear form along the center pillar, and a third frame 22C connected to the other end (a left side in the drawing) of the first frame 22A and extending in parallel to the second frame 22*b*.

The second frame 22A and the third frame 22C are curved according to a design on the automobile body, and they have respective end portions (lower end portions) extended into the housing section 23.

The glass sheet 30 exhibits a substantially trapezoidal shape in a plan view, which is defined by a rear side portion 31 guided by the second frame 22B and a front side portion 32 guided by the third frame 22C. The glass sheet has a curved front face to provide an arched face or a spherical face according to a design of the automobile body.

The glass sheet 30 is movable vertically by the guidance of the second frame 22B and the third frame 22C from the lowest position at which it is entirely housed in the housing section 23 to the highest position at which it contacts the first frame 22A of the sash 22. The size of the glass sheet 30 is determined to have such a size that a lower side portion 33 of the glass sheet is not exposed to the outside from the opening 24 at the highest position.

The opening and shutting structure for a window member 11 comprises an elevating means or mechanism 40 for raising or lowering the glass sheet 30 with respect to the door main body 20 and an elastic member 50 for urging the glass sheet 30 in a direction projecting from the door main body 20.

The elevating means 40 is provided with an elevating member 41 extending along a rear side portion 31 of the glass sheet 30 to have a predetermined length and fixed to the rear end portion, and a driving section 42 for moving the elevating member 41 in its longitudinal direction.

Figure 2:
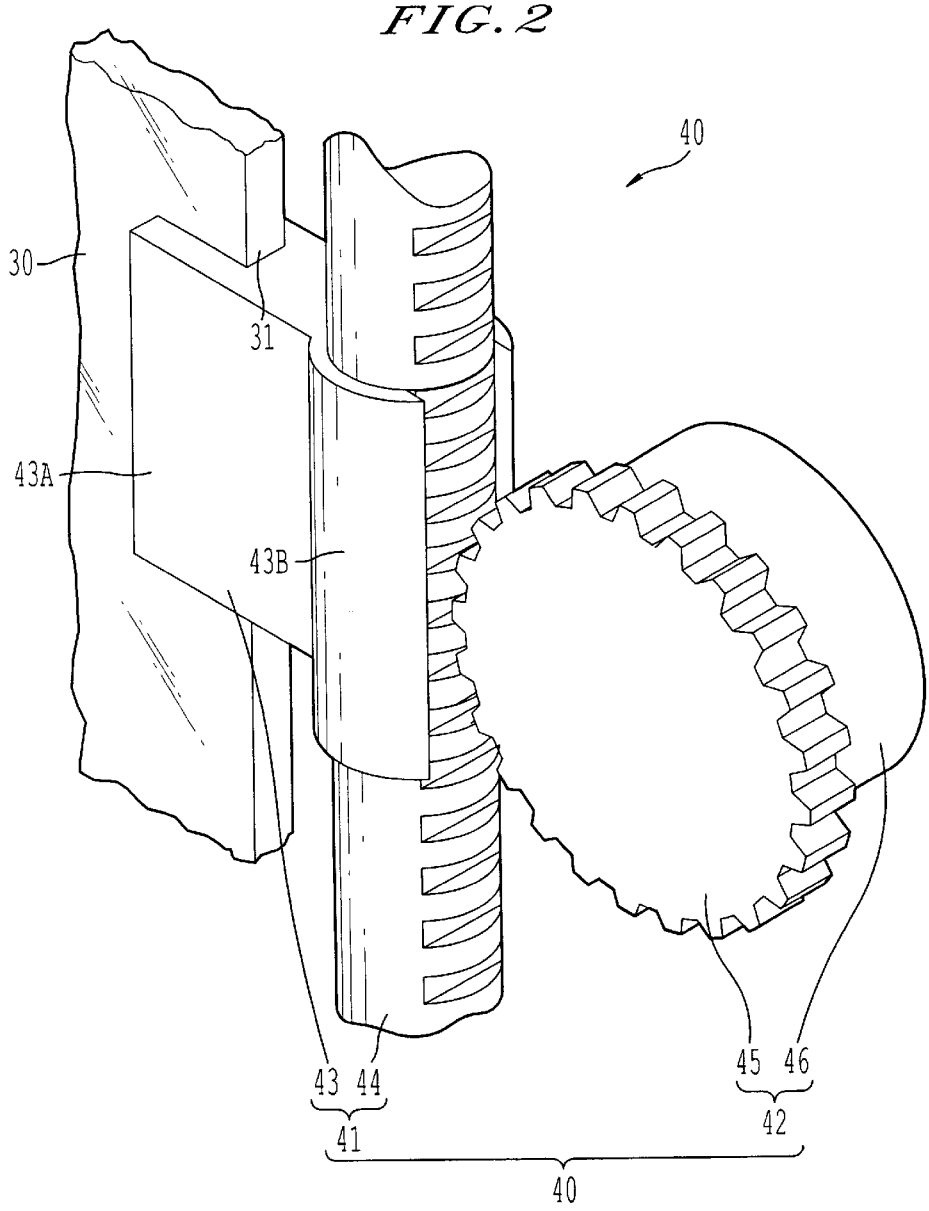
FIG. 2 is a perspective view partly omitted of an embodiment of an elevating means.

As shown in FIG. 2, the elevating member 41 has a fitting member 43 fixed to the glass sheet 30 and a round rod-like rack 44 fixed to the fitting member 43.

The fitting member 43 is provided with a holding portion 43A of a substantially U-shape which can hold the glass sheet 30 in a direction of the width and a grasping portion 43B of substantially C-shape which can grasp the rack 44, these portions being in a one piece body made of a hard resin. The fitting member 43 can fix certainly the rack 44 along the rear side portion of the glass sheet 30 without causing any slippage to the glass sheet 30 and the rack 40. The rack 44 is made of a suitable metal, has teeth formed in parallel to a direction tangential to the round rod with predetermined intervals in a longitudinal direction, and is curved so as to correspond to the second frame 22B. An adhesive agent or the like may be additionally used in order to fix the fitting member 43 to the glass sheet 30 and the rack 44.

The driving section 42 is held in the housing section 23 and is fixed to the inner panel or the outer panel 21, which depends on a space in the housing section 23. In this embodiment, the driving section 42 is fixed to the outer panel 21. The driving section 42 includes a pinion gear 45 meshed with the rack 44 of the elevating member 41. By driving the pinion gear 45 by a motor 46, the elevating member 41 can be moved vertically along a longitudinal direction of the rack.

The driving section 42 can raise or lower the glass sheet 30 by means of the elevating member 41 by rotating positively or reversely the motor 41 by operating a switch providing on an inner liner as a constituent element of the door main body 20. Since the grasping portion 43B of the fitting member 43 is of a substantially C-shape, there is no risk of interfering with the meshing of the rack 44 and the pinion gear 45.

Figure 3:
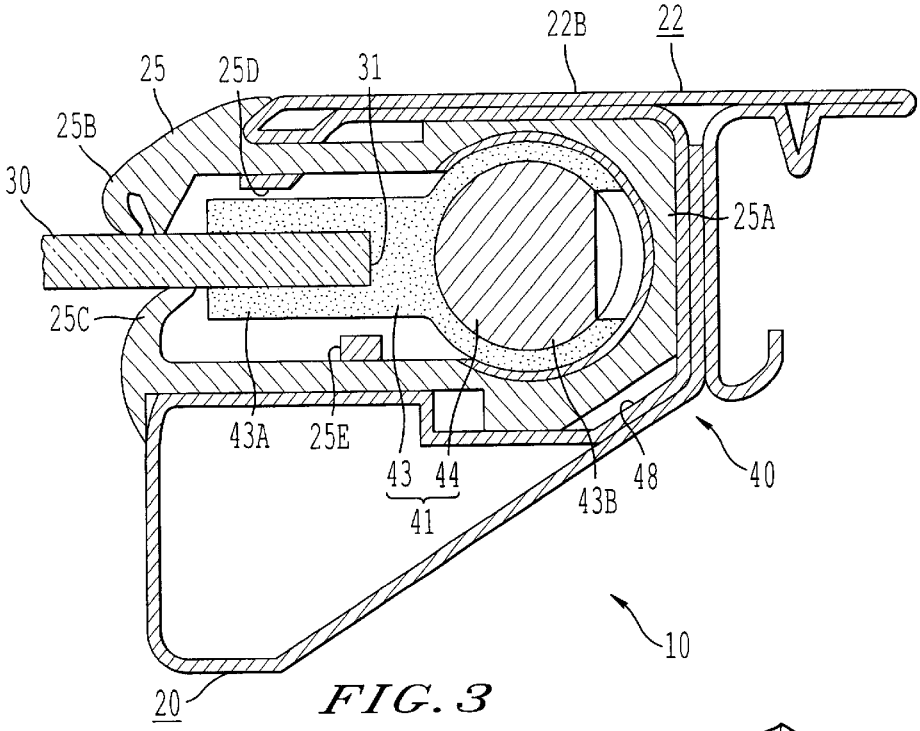
FIG. 3 is a cross-sectional view showing an embodiment of a slide-contact member.

As shown in FIG. 3, the elevating means or mechanism 40 is raised or lowered so that the elevating member 41 is guided by the second frame 22B of the sash 22. The second frame 22B has a guiding portion 48 which is formed in a substantially U-shape in cross section by press-molding.

In the guiding portion 48, a weather strip 25 as a slide-contact member is arranged. The weather strip 25 has an elongated body made of a soft resin having elasticity and a weather resistance and having a continued cross-sectional shape of substantially U-shape and is press-fitted in a state of an elastic deformation into the guiding portion 48.

The weather strip 25 is provided with a slide-contact portion 25A of substantially C-like shape in cross section, a surface of which is in slide-contact with an outer peripheral surface of the grasping portion 43B of the fitting member 43, and a pair of lips 25B, 25C which are in elastically slide-contact with both front and rear surfaces of the glass sheet 30.

Further, the weather strip 25 is provided with ribs 25D, 25E between the slide-contact portion 25A and the lips 25B, 25C. The ribs 25D, 25E are usually projected so as not to contact the holding portion 43A. These ribs 25D, 25E, even when the glass sheet 30 is swung around the axial center of the rack 44, will contact the holding portion 43A, whereby an angle of deflection of the glass sheet 30 can be restricted so as not to exceed a predetermined value.

In such weather strip 25, the hardness of an inner peripheral surface of the slide-contact portion 25A and the hardness of the surfaces of the ribs 25D, 25E are determined to be higher than the surfaces of other portions. Accordingly, even when the elevating member 41 is raised or lowered overall, there is no risk of wearing of the inner peripheral surface of the slide-contact portion 25A, and a deflection of the glass sheet 30 can certainly be controlled.

The inner peripheral surface of the slide-contact portion 25A and the front surfaces of the ribs 25D, 25E are formed in such a manner that, for example, the operation of molding the weather strip 25 is divided into two stages and a plurality of types of resin having different compositions are injected. Alternatively, it is possible to form the surfaces by co-extrusion-molding a plurality of types of resin having different compositions.

Returning to FIG. 1, the elastic member 50 is a leaf spring made of an appropriate metallic strip which is curved to have a substantially U-shape, and is arranged laterally in the housing section 23. The elastic member 50 has an end portion (an upper end portion) connected to the lower side portion 33 of the glass sheet 30 and the other end portion (a lower end portion) fixed to a fixing portion 26 provided at a bottom portion of the housing section 23.

Figure 4:
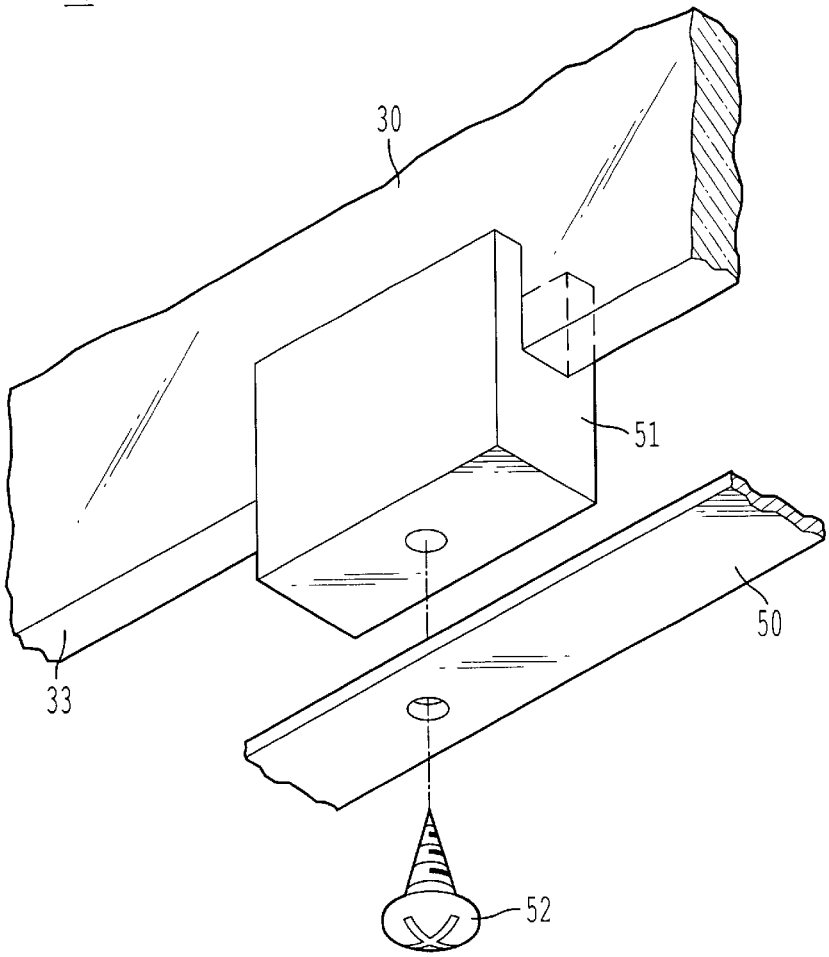
FIG. 4 is a perspective view partly omitted showing an embodiment of a style of connecting a window member and an elastic member.

The elastic member 50 is attached to the lower side portion 33 of the glass sheet 30 by means of a pair of connecting members 51. As shown in FIG. 4, each of the connecting members 51 is made of a hard resin so as to have a substantially U-like shape and is capable of holding the glass sheet 30 in its width direction.

These connecting members 51 are disposed with a predetermined interval at positions toward a front side of the automobile with respect to an intermediate portion in the lower side portion 33 of the glass sheet 30. The elastic member 50 is attached to the lower side portion 33 of the glass sheet 30 by engaging the connecting members 52 with connecting screws 52 which penetrate the elastic member 50 in its width direction. Accordingly, an end portion (e.g. an upper end portion) of the elastic member 50 is attached to a position toward a front side 32 with respect to the rear side portion 31 at which the elevating member 41 is attached to the glass sheet 30. in the lower side portion 33 of the glass sheet 30. The elastic member 50 is attached to the lower side portion 33 of the glass sheet 30 by engaging the connecting members 52 with connecting screws 52 which penetrate the elastic member 50 in its width direction. Accordingly, an end portion (an upper end portion) of the elastic member 50 is attached to a position toward a front side 32 with respect to the rear side portion 31 at which the elevating member 41 is attached to the glass sheet 30.

A description will be set forth as to operations of raising and lowering the glass sheet 30 to the above-mentioned side door 10 with reference to FIG. 1.

To ascend the glass sheet 30 housed in the housing section 23 of the door main body 20, the motor 46 is actuated by operating a switch (not shown), so that the elevating member 41 is moved upward along its longitudinal direction by means of the pinion gear 45 driven by the motor 46 located positively.

In this case, since the glass sheet 30 as a relatively heavy article is urged by the elastic member 50 in a direction projecting from the door main body 20, it is smoothly ascended on the actuation of the motor 46.

Further, since an end portion of the elastic member 50 is connected to the front side portion 32, there is no risk of causing the declination of the front side portion 32 due to the own weight even when the rear side portion 31, which is along the center pillar, is ascended by means of the elevating member 41, and the glass sheet is ascended in parallel.

In descending the glass sheet 30 which shuts a space in the sash 22, the elevating member 41 is moved downward along its longitudinal direction by the pinion gear 45 rotated inversely by operating a switch (not shown). With this, the glass sheet 30 is descended keeping a horizontal state while the elastic member 50 is deformed so as to bring the both end portions closer. In this case, the rack 44 is accommodated in a cylindrical portion 27 formed in the housing section 23 of the door main body 20 after the rack has been passed the pinion gear 45.

In the opening and shutting structure for a window glass 11, the elevating member 41 is attached to the rear side portion 31 of the glass sheet 30, which extends in a direction of ascending and descending. Accordingly, the motor 46 for moving the elevating member 41 can be arranged at a corner portion of the housing section 23.

Further, the glass sheet 30 is urged by the elastic member 50 in a direction projecting from the housing section 23. Accordingly, when the glass sheet 30 as a heavy article is to be ascended, the motor 46 can smoothly be actuated whereby a quick ascending operation of the glass sheet 30 can be realized.

In the glass sheet 30, in particular, the elastic member 50 is attached to the lower side portion of the glass sheet 30 at a position toward the front side portion 32. Accordingly, even when the elevating member 41 is attached only to the rear side portion 31, there is no risk that a side of the front side portion 32 declines due to its own weight, and a parallel state can be maintained. Further, since the elastic member 50 is a leaf spring formed to have a substantially U-shape, the structure of the door main body 20 can be simplified and the weight can be reduced.

Furthermore, according to the opening and shutting structure for a window glass 11, the elevating member 41 is guided by the frame 22B, whereby the glass sheet 30 can certainly be raised or lowered without causing a deflection of the glass sheet 30.

In addition, since the glass sheet 30 is guided by the weather strip 25, which is along the second frame 22B, a water resistance can be assured, and there is no risk of the deflection of the glass sheet in being raised or lowered. In particular, the weather strip 25 can improve durability since the slide-contact portion 25A and the ribs 25D, 25E are subjected to a hardwearing treatment.

Further, according to the above-mentioned opening and shutting structure for a window glass 11, the rack 44 of the elevating member 41 is meshed with the pinion gear 45 of the driving section 42 whereby the glass sheet 30 can certainly be ascended or descended without causing a defective operation such as slippage. In particular, since the rack member 44 is of a round rod-like material, it can easily be curved in correspondence to the shape of the glass sheet 30 or the second frame 22B.

In the elevating means or mechanism 40, the fitting member 43 and the rack 44 of the driving section 42 can be used in a selective manner. Accordingly, they can be used for another type of automobile or another usage. Therefore, there is obtainable universality.

The present invention is not limited to the above-mentioned embodiment, but an appropriate modification or improvement is possible. In the above-mentioned embodiment, the elevating member of the elevating means or mechanism is attached only to a side face of the glass sheet. However, the present invention includes a style that elevating members are attached to a pair of parallel side faces of the window member, for example. In this case, the presence or absence of the elastic member is optional. The style that elevating members are attached to a pair of parallel side faces of the window member is preferable from a viewpoint that a high supporting strength to the window member is obtainable. The style to obtain a high supporting strength can effectively be used, in particular, for a hard-topped automobile.

The elevating means or mechanism is not limited to the combination of the rack and the pinion gear, but a style that a strip-like elevating member is held by a pair of rollers may be employed, for example. However, use of the combination of the rack and the pinion gear is preferable from the viewpoints that the window member can be raised or lowered accurately according to a driver's requirement, depending on an amount of a driving operation to the motor, and the rigidity of the overall elevating structure can be maintained. Further, it is possible to utilize a structure that notches for the rack of the elevating member are formed in the window member itself.

As to use or non-use of the elastic member, the following technique is acceptable. Namely, the elastic member may not be provided when the declination of the front side portion of the window member due to its own weight can be prevented by a holding strength of the weather strip to the window member. In this case, it is preferable to add such a member as described with reference to FIG. 5, to the window a member if there is a risk that the ascending or descending operation of the window member is hindered by a resistance of the weather strip.

Figure 5A:
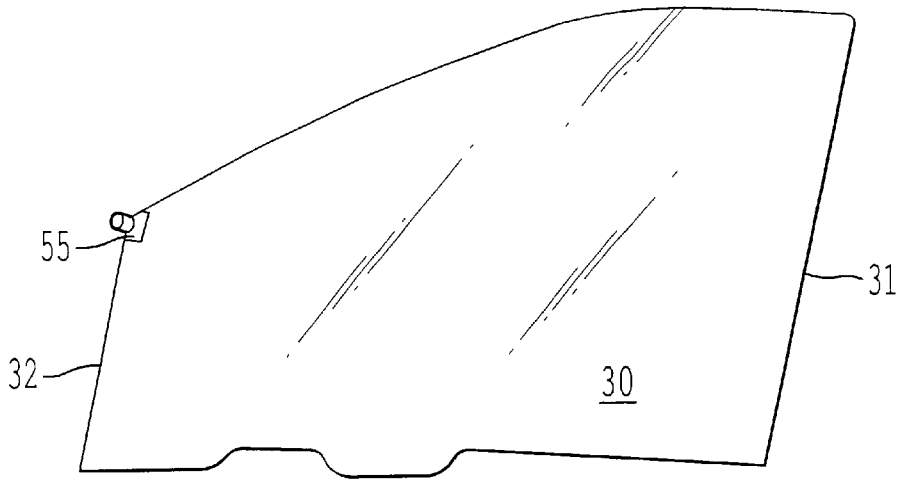
FIG. 5*a* is a front view showing an example wherein an additional tool is provided at a front side of a window member.
Figure 5B:
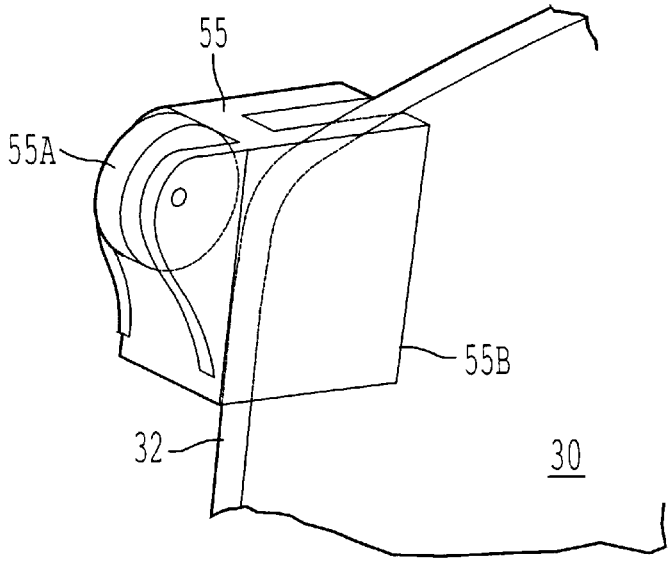
FIG. 5*b* is an enlarged perspective view showing a primary portion.

FIG. 5*a* is a front view showing an example that an additional member is provided at a front side portion of the window member, and FIG. 5*b* is an enlarged perspective view of a primary portion wherein the elevating member to be fixed to the rear end portion of the glass sheet 30 is omitted. A guiding auxiliary member 55 is provided at a front side portion 32 of the glass sheet 30. The guiding auxiliary member 55 is provided with a main body 55B having a glass receiving portion of substantially U-shape in a cross section and a roller 55A provided in the glass receiving portion so as to project from the front end portion 32 of the glass sheet.

The guiding auxiliary member 55 is bonded to the glass sheet 30 by means of an adhesive provided in the glass receiving portion. Alternatively, the guiding auxiliary member may be attached to the glass sheet, which is previously perforated, by using a screw.

With a vertical movement of the rear side portion of the glass sheet which is caused by the movement of the elevating member, the roller 55A is rotated and guided along a bottom portion of U-like shape formed in the third frame, whereby the glass sheet 30 can smoothly be ascended or descended while the front side portion 32 and the rear side portion 31 of the glass sheet 30 can be maintained to be in a parallel state. It is preferable to form a structure that the guiding auxiliary member 55 is in its entirety received in the third frame in order to conceal the guiding auxiliary member 55.

Besides the leaf spring of substantially U-like shape as the elastic member, a leaf spring of substantially V-like shape, substantially O-like shape, S-like shape or substantially W-like shape may be employed. Further, besides the leaf spring as the elastic member, a compression spring or a tensile spring, an appropriate rubber or a cylinder device may be utilized. However, use of a leaf spring is preferable from the standpoint that a space in a central portion of the housing section can easily be maintained.

As the elevating member, the rack in which teeth are formed in parallel to a direction tangential to a circle of the round metallic rod is exemplified. However, a rack wherein a large diameter portion and a small diameter portion are alternately formed along its longitudinal direction in the round metallic rod, may be used. Use of such rack permits to bend easily in the correspondence to the frame.

Other than the glass sheet as the window member, a transparent synthetic resin plate can be used. In a case that the above-mentioned rack of the elevating member is substituted with a structure that notches for a rack are formed in the window member itself, it is effective to use a synthetic resin plate from a viewpoint of easy formation. However, use of a glass sheet is preferable since the rigidity of a door in its entirety can be assured.

In the embodiments described above, a side door for a front seat of an automobile is exemplified. However, the present invention is applicable to a side door for a rear seat or the tail gate. Further, the present invention is applicable not only to an automobile but also to a railway, a ship, an aircraft, a building, or any type of machine tool. In the consideration that the housing section has a limited space, it is preferable that the elevating structure for the window member of the present invention is used for a door, in particular, a side door for an automobile.

Further, the material, the shape, the dimensions, the style, the number, positions to be located, and so on of the window member, the housing section, the elevating means, the elevating member, the driving section, the elastic member and so on which are exemplified in the above-mentioned embodiment are optional and are not limited thereto as far as the present invention can be achieved.

INDUSTRIAL APPLICABILITY

As described above, according to the present invention, the elevating member is attached to a side portion of the window member in a direction of ascending or descending the window member, whereby the driving section such as a motor can be located in a corner portion of the door main body.

In particular, since the window member is urged by the elastic member in a direction projecting from the housing section, the window member as a heavy article can smoothly be ascended immediately after the actuation of the driving section. In this case, there is no risk that the window member inclines due to its own weight since the elastic member is in contact with a side portion of the window member at position opposing a side portion where the elevating member is attached.

Further, in the application of the present invention of a window for an automobile, the elevating means of a large volume, such as a heavy article, can be located without interfering various equipment disposed in a central portion of the door main body.

What is claimed is:

1. An opening and shutting structure for a window, comprising:

a housing positionable in a lower portion of a window opening to house a window member and an elevating member for raising or lowering a window between the window opening and the housing wherein said housing comprises a window frame for framing said window member, said elevating member having a predetermined length and being fixable to said window member in proximity with a rear side portion of said window member;

a driving member housed in the housing to move said elevating member in a longitudinal direction, said elevating member being fixable to a rear side portion of the window member so as to be moveable in said window frame along an ascending/descending direction; and an elastic member housed in said housing for urging the window member in a direction for projecting the window member from said housing, said elastic member being attached to a lower side portion of the window member to urge the window member in a direction for projecting the window member from the housing section.

2. The opening and shutting structure for a window member according to claim 1, wherein the window member comprises a window member for an automobile, and said housing is positionable in a door main body of the automobile.

3. The opening and shutting structure for a window member according to claim 2, wherein said housing is provided between an inner panel and an outer panel of the door main body of the automobile.

4. The opening and shutting structure for a window member according to claim 3, wherein said elevating member is fixable to a side portion, which faces a rear side of the automobile, of the window member of a door of the automobile.

5. The opening and shutting structure for a window member according to claim 4, wherein said window opening is formed in a portion surrounded by a door waist member and frame member which comprises first frame member along a roof side rail of the automobile body and second and third frame member each of which is respectively connected to each of front and rear side ends of the first frame member with respect to the automobile body, a second and third frame member being extended parallel to each other along a direction of ascending or descending the window member.

6. The opening and shutting structure for a window member according to claim 5, wherein said elevating member is movable in a guiding member, in a direction of the raising or lowering the window member, the regulating member having a substantially U-shape in cross section and being provided at one of the second and third frames.

7. The opening and shutting structure for a window member according to claim 3, wherein said window opening is formed in a portion surrounded by a door waist means and a frame member which comprises first a frame member along a roof side rail of the automobile body and a second and third frame member each of which is respectively connected to each of front and rear side ends of the first frame member with respect to the automobile body, said second and third frame member being extended parallel to each other along a direction of ascending or descending the window member.

8. The opening and shutting structure for a window member according to claim 7, wherein said elevating member is movable in a guiding means, in a direction of the raising or lowering the window member, the regulating member having a substantially U-shape in cross section and being provided at one of the second and third frames.

9. The opening and shutting structure for a window member according to claim 2, wherein said elevating member is fixable to a rear side portion of the window member and the window member is located on a door of the automobile.

10. The opening and shutting structure for a window member according to claim 9, wherein said window opening is formed in a portion surrounded by a door waist means and a frame member which comprises a first frame member along a roof side rail of the automobile body and a second and third frame member each of which is respectively connected to each of front and rear side ends of the first frame member with respect to the automobile body, a said second and third frame member being extended parallel to each other along a direction of ascending or descending the window member.

11. The opening and shutting structure for a window member according to claim 10, wherein said elevating member is movable in a guiding means, in a direction of the raising or lowering the window member, the regulating member having a substantially U-shape in cross section and being provided at one of the second and third frames.

12. The opening and shutting structure for a window member according to claim 2, wherein said window opening is formed in a portion surrounded by a door waist member and a frame assembly which comprises a first frame member along a roof side rail of the automobile body and a second and third frame member each of which is respectively connected to front and rear side ends of the first frame with respect to the automobile body, the second and third frame members extending parallel to each other along a direction of ascending or descending the window member.

13. The opening and shutting structure for a window member according to claim 12, wherein said elevating member is movable in a guiding member, in the direction of raising or lowering the window member, the elevating member having a substantially U-shaped cross section and being provided at one of the second and third frames.

14. An opening and shutting structure for a window, comprising:

a housing positionable in the lower portion of a window opening to house the window member and an elevating member for raising or lowering a window between the window opening and the housing, said elevating member having a predetermined length and being fixable to said window member, and a moving member housed in the housing to move said elevating member in a longitudinal direction, said elevating member being fixable to a rear side portion of the window member so as to be movable along an ascending/descending direction, wherein said elevating member is provided with a rack which is extended in a direction of ascending or descending the window member and is fixed to a side portion of said window member, and wherein said moving member is provided with a pinion gear fixed to the door main body of the automobile and means for rotating the pinion.

15. The opening and shutting structure for a window member according to claim 14, wherein said window opening is formed in a portion surrounded by a door waist means and frame member which comprises first frame member along a roof side rail of the automobile body and second and third frame member each of which is respectively connected to each of front and rear side ends of the first frame member with respect to the automobile body, a second and third frame member being extended parallel to each other along a direction of ascending or descending the window member.

16. The opening and shutting structure for a window member according to claim 15, wherein said elevating member is movable in a guiding means, in a direction of the raising or lowering the window member, the regulating member having a substantially U-shape in cross section and being provided at one of the second and third frames.

17. An opening and shutting structure for a window, comprising:

a housing positionable in a lower portion of a window opening to house a window member and an elevating member for raising or lowering a window between the window opening and the housing, said elevating device comprising an elevating member which has a predetermined length and being fixable to said window member;

a driving device housed in the housing to move said elevating member in a longitudinal direction, said elevating member being fixable to a rear side portion of the window member so as to be moveable along an ascending/descending direction; and an elastic member housed in said housing means for urging the window member in a direction for projecting the window member from said housing;

wherein said elastic member is attached to a lower side portion of the window member so that the elastic member urges the window member in a direction for projecting the window member from the housing section.

18. The opening and shutting structure for a window member according to claim 17, wherein said elastic member contacts a side portion of the window member so as to face a side of the window member where said elevating member is attached.

19. An opening and shutting structure for a window, comprising:

a housing positionable in a lower portion of a window opening to house a window member and an elevating member for raising or lowering a window between the window opening and the housing, said elevating member having a predetermined length and being fixable to said window member;

a driving member housed in the housing to move said elevating member in a longitudinal direction, said elevating member being fixable to a rear side portion of the window member so as to be moveable along an ascending/descending direction; and an elastic member housed in said housing for urging the window member in a direction for projecting the window member from said housing; and wherein said elastic member is attached to a lower side portion of the window member so that the elastic member urges the window member in a direction for projecting the window member from the housing.

20. The opening and shutting structure for a window member according to claim 19, wherein said elastic member contacts a side portion of the window member so as to face a side where said elevating member is attached.

21. An opening and shutting structure for a window, comprising:

a housing positionable in a lower portion on a window opening to house a window member and an elevating member for raising or lowering the window member between the window opening and the housing, said elevating member having a predetermined length and being fixable to said window member, and a driving member housed in said housing for moving said elevating member in longitudinal direction, said elevating member being fixed to a side portion of the window member so as to by movable along an ascending/descending direction and wherein said elevating member includes a rack which is extended in a direction of raising or lowering the window member and is fixable to a side portion of the window member, said driving member being provided with a pinion gear fixed to the window member of the automobile and a motor for rotating the pinion gear.

22. An opening and shutting structure for a window, comprising:

a housing positionable in a lower portion on the window opening to house the window member and an elevating member for causing the window member to raise or lower between a window opening and the housing section, the elevating member having a predetermined length and being fixed to said window member, and a driving member housed in a housing section to move the elevating member in a longitudinal direction, said elevating member being fixed to a side portion on the window member so as to be movable along an ascending/descending direction wherein an elastic member is housed in said housing and is attached to a lower side portion of the window member so that the elastic member urges the window member in a direction for projecting the window member from the housing means.

23. An opening and shutting structure for a window, comprising:

a housing provided in a lower portion on the window opening to house the window member and an elevating member for causing the window member to raise or lower between the window opening and the housing, said elevating member having a predetermined length and being fixed to said window member at a position in proximity with a rear side portion of said window member, and a driving member housed in a housing section to move the elevating member in a longitudinal direction, said elevating member being fixed in proximity with said rear side portion of the window member so as to be movable along an ascending/descending direction wherein said housing includes a frame for framing the window within a portion of which the elevating member is movable and wherein an elastic member is housed in said housing and attached to a lower side portion of said window member for urging the window member in a direction for projecting the window member from said housing.

* * * * *